United States Patent [19]

Greene

[11] 4,055,202

[45] Oct. 25, 1977

[54] IN-CASE BOTTLE FILLING APPARATUS

[76] Inventor: James Albert Greene, 455 Tiffany, Richardson, Tex. 75080

[21] Appl. No.: 700,758

[22] Filed: June 29, 1976

[51] Int. Cl.[2] ..... B65B 3/04

[52] U.S. Cl. ..... 141/59; 141/275; 141/237; 141/301; 251/63

[58] Field of Search ..... 141/275, 277, 237; 251/325, 353, 63, 1, 4–9, 47, 48, 51, 52, 59, 148–150, 172, 238, 250–284, 369–381, 285–310

[56] References Cited

U.S. PATENT DOCUMENTS

| | | | |
|---|---|---|---|
| 900,076 | 10/1908 | Asbell | 251/63 |
| 952,605 | 3/1910 | Connors et al. | 251/63 |
| 3,595,280 | 7/1971 | Fissel | 141/275 |

*Primary Examiner*—Houston S. Bell, Jr.
*Attorney, Agent, or Firm*—Warren H. Kintzinger

[57] ABSTRACT

A bottle filling device which raises in-case bottles to be filled to engagement with a fill valve assembly which controls fluid communication between a fill tube inserted into each bottle and a pressurized fill tank. Cup members, which engage the bottle openings in fill position, communicate with a vacuum line, such that the combination of pressurized fill source and air-evacuated bottles realizes extremely fast filling. The fill tubes are the shafts of respective double acting fluid pressure operated cylinders of simple construction which position a port in the fill tube upper wall extremes within the fill tank confines or within pressure sealing cylinder end bushings to define respective open and closed fill-valve conditions.

12 Claims, 5 Drawing Figures

IN-CASE BOTTLE FILLING APPARATUS

Figure 1:
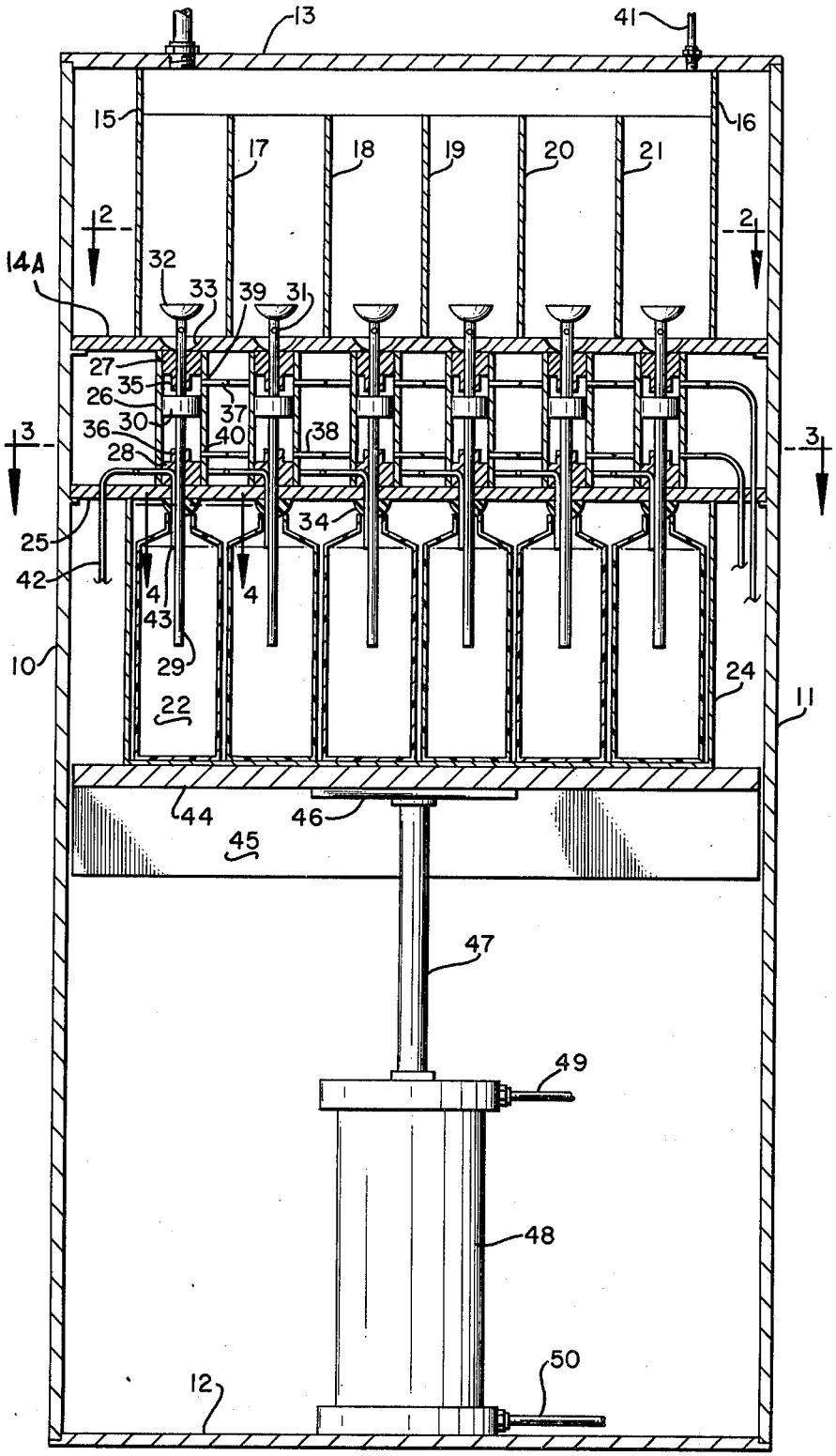

This invention relates in general to bottle filling apparatus and, in particular, to an in-case bottle-filling device for rapidly transferring premeasured liquid quantities into a plurality of case-held empty containers.

Bottle filling machines have long been used for simultaneously filling a number of milk or other bottles. Some incorporate predetermined measures of liquid for each bottle. Others employ the "in-case" filling feature, wherein a number of empty bottles in a packing container are position-oriented to communicate with individual ones of plural filling tubes. Various air venting means are known by which a ready escape of air is provided for each bottle as it is filled, particularly in cases where the bottle neck engagingly opens a fill valve between supply source and the bottle. Individual ones and combinations of these features are found, for example, in U.S. Pat. Nos. 1,419,235 Desobry, 917,155 Sanders, 963,119 Champ, 650,309 Denham, and 212,494 Paddock.

Prior art devices, such as typlified above, are generally concerned with a gravity flow of liquid into the bottles at a flow rate determined by restrictions imposed by fill tube geometry and the viscosity of the liquid being bottled. Manual operations imposed by known devices, further impose time consumption in filling.

It is, therefore, a principle object of this invention to provide an automatic in-case bottle filling machine utilizing pressure filling of measured amounts of liquid into each of a plurality of bottles.

Another object of the invention is to provide a selectable pressure filling system in conjunction with means for selectively air evacuating the bottles to be filled, whereby fill rates may be varied to most expeditiously cope with varying supply liquid viscosities and gas content.

Still another object is the provision of an automatic in-case bottle filling machine which may incorporate a timed filling feature with fill content controllable by supply tank pressure and/or container vacuum.

A further object of the invention is the provision of sequentially controllable fluid pressure fill tube valve means employing relatively simple and inexpensive fluid pressure operated piston means to permit precise control of time filling operations under conditions of bottle vacuum pressures and supply source tank pressures.

Features of this invention useful in accomplishing the above objects, include, in an automatic in-case bottle filling machine, an adjustable pressurized supply source oriented over an elevatable table upon which a compartmented bottle holding case may be placed.

Fill tubes extending through the fill tank bottom, and individually coextensive with the respective bottle neck axes, are vertically positionable by means of pistons affixed thereto which are carried within respective double-acting pressure cylinders. Openings in the fill tube upper wall extremes communicate with the pressurized fluid supply tank with the pistons in the upper position, and are drawn within cylinder end bushings with the pistons in the lower position, while valve cup seal means carried on the fill tube upper ends are drawn into mating valve seat means arranged in the fill tank base. The fill tubes extend through a base plate member upon which the cylinder rest, and slidably pass through bushing-like securing cups against which the bottle necks sealingly engage for filling. Also passing through each securing cup is a fixed-position second tube extending only into the upper neck confines of the bottles as they engage the securing cups; the second tubes communicating in common with ambient atmosphere or, preferably, with a vacuum line source. A source of compressed air is sequentially applied through sequented control valves to operated a two-way cylinder to raise and lower the table between load/unload and fill positions as well as to operate the fill tube pistons to open and close the fill valve means.

A specific embodiment representing what is presently regarded as the best mode of carrying out the invention is illustrated in the accompanying drawing.

Figure 2:
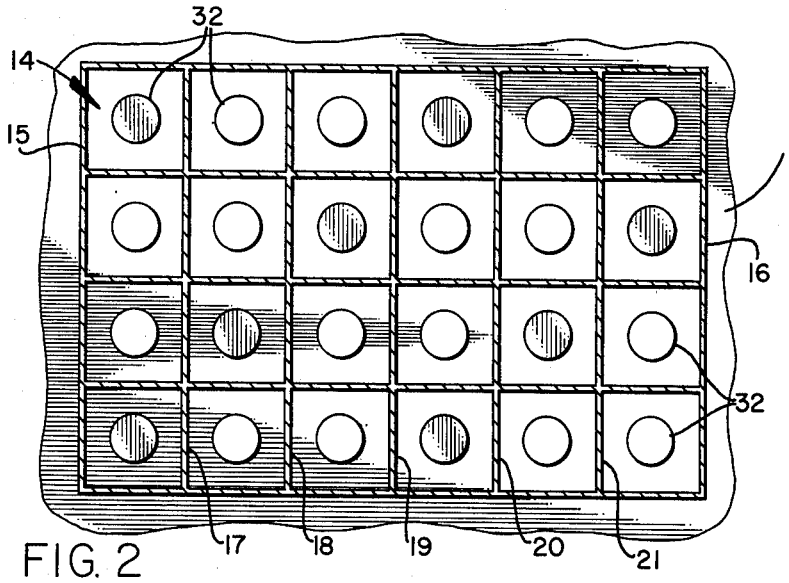
Figure 3:
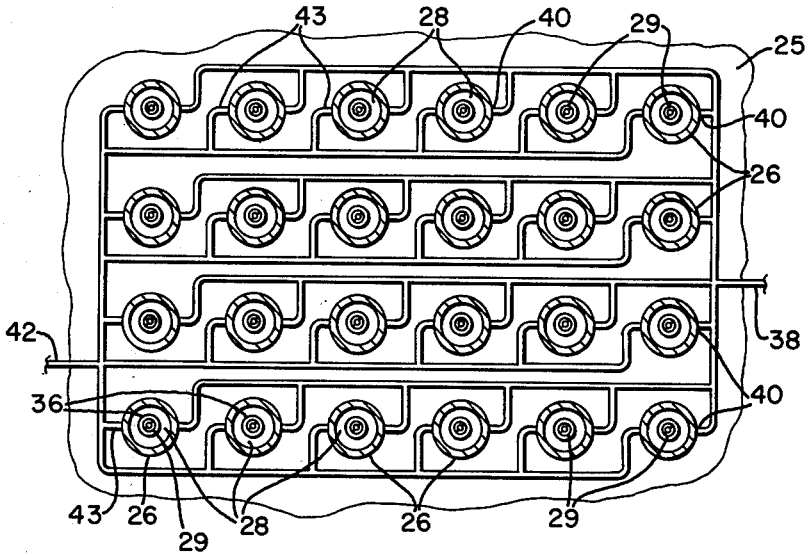
Figure 4:
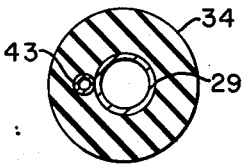

In the drawing:

FIG. 1 represents a partially sectioned elevation view of the in-case bottle filling machine;

FIG. 2, a top view taken along line 2—2 of FIG. 1;

FIG. 3, a top view taken along line 3—3 of FIG. 1;

FIG. 4, a top view taken along line 4—4 of FIG. 1; and

Figure 5:
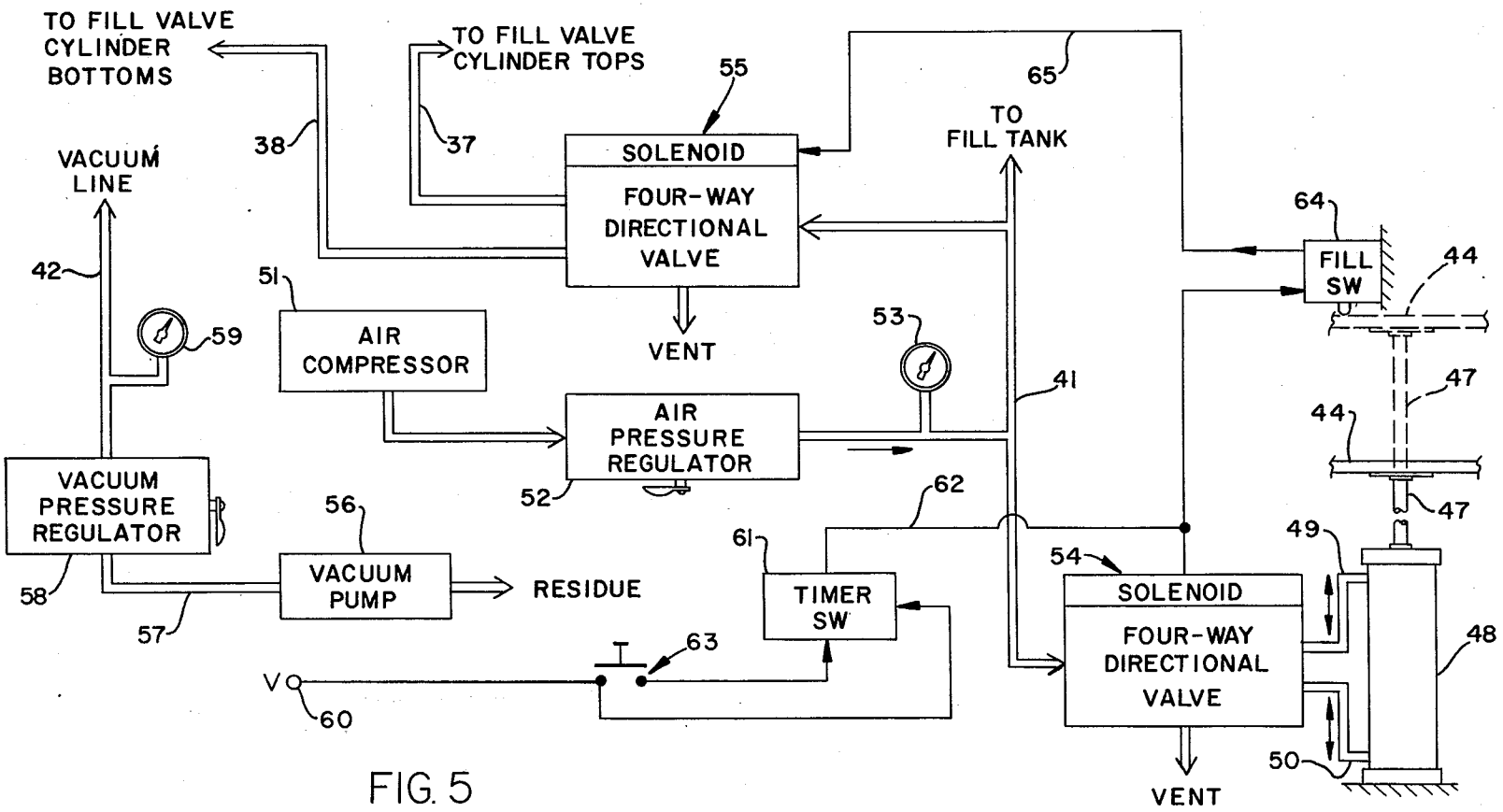

FIG. 5, a functional diagram of a control system for the embodiment shown in FIG. 1.

Referring to the drawings:

The machine of FIG. 1 is generally rectangular in shape. Side wall members 10 and 11 extend from base plate 12 to top plate member 13. A pressure tank 14 is carried between top plate 13 and support or tank base plate 14A. Tank 14 may be compartmented between tank end-walls 15 and 16 by divider plates 17-21 to define plural compartments each volumetrically equalling that of one of the bottles 22 to be filled. As embodied herein, the tank may be divided into twenty-four compartments in four rows of six, to accommodate in-case filling of twenty-four bottles arranged in a similar matrix position geometry within an appropriately dimensioned and compartmented case 24.

A fluid pressure operated fill valve means and associated fill tube is provided for each of the fill tank compartments, i.e., one such device for each bottle to be filled.

As shown in FIG. 1, the valves comprise double acting-cylinder members carried between a mounting plate 25 and the base plate 14A of the fill tank. Each valve and fill tube assembly, as typlified for that shown communicating with one compartment in fill tank 14, comprises a cylinder 26 fitted with respective top and bottom bushings 27 and 28 through which a fill tube 29 extends. Bushings 27 and 28 provide end seals against the cylinder walls as well as providing a sliding seal between fill tube 29 and the bushings.

Fill tube 29 comprises the shaft for a piston member 30, such that upper and lower piston positions within cylinder 26 define upper and lower-positions for the fill tube 29. The fill tube is provided with a wall opening 31 in the upper extremetythereof which is caused to provide a fluid communication with the fill tank when the tube 29 is in the upper position as indicated in FIG. 1. The top end of the fill tube is fitted with a valve seal 32 shaped to conform with a valve seat 33 which may be formed in cylinder top bushing 27. With the fill tube 29 in the lower position, valve seal 32 seats within valve seat 33 with fill tube opening 31 withdrawn into upper cylinder bushing 27 such that there is no longer a fluid communication between fill tube 29 and the fill tank.

It is to be relized that numerous implementations of the upper cylinder bushing 27 may provide the desired result — that of maintaining a sliding fluid seal between the fill tube and the fill tank, and causing fill tube wall opening 31 to communicate with the fluid in the fill tank with the tube in the upper position and to be withdrawn into the upper bushing 27 with the fill tube in the lower position.

The fill tubes slideably extend through the mounting plate 25 and into the confines of the bottles to be filled. Referring again to typical fill tube 29, a securing cup member 34 is affixed to the underside of plate 25. Tube 29 slidably extends through cup 34 and into the confines of associated bottle 22 when the bottles are in the illustrated fill position. Cup 34 maintains a sliding fluid seal with fill tube 29 and is shaped with a convex surface which sealingly engages the bottle-neck opening.

Referring again to the cylinder valve fill assemblies, as referenced to the typical assembly associated with fill tube 29, the upper and lower cylinder bushings 27 and 28 are formed with respective inner-extending stop faces 35 and 36 which provide limit stops for respective upper and lower positions of piston 30, with the upper stop face 35 providing assurance that the opening 31 in fill tube 29 remains within the bushing 27 when piston is in the lower position. Fluid pressure lines 37-38 are connected to respective top and bottom cylinder ports 39 and 40, such that controlled application of fluid pressure to the top line 37 forces the piston 30 down to close the fill valve, while application of fluid pressure to the bottom line 38 forces the piston 30 upward to open the fill valve. Here it is seen that the cylinder bushing stop faces preclude engagement between piston 30 and either of the fluid pressure ports 39 and 40.

The above described fill valve assemblies and associated securing cup members which engage the bottle necks are seen to maintain a fluid seal between the fill tank and each of the bottles. Thus, as depicted in FIG. 1, an air pressure line 41 may be affixed to the fill tank to provide a pressure fill operation. Cooperating with this feature is provision for venting each of the bottles to permit air escape as it is displaced by the rising fluid level in the bottles. For this purpose a second tube is passed through each of the securing cups and extended sufficiently to enter the bottle confine as the bottle neck engages the cup. Referring again to FIG. 1, a common line 42 communicates with a short tube 43 which extends through securing cup 34 into the neck of bottle 22. Similar branches of line 42 are extended into each of the fill-positioned bottles. Line 42 may communicate with ambient atmosphere, however, it is preferrable that line 42 communicate with a vacuum source, whereby the combination of pressurized fill tank and vacuumized air venting permit an extremely rapid filling operation.

The in-case bottles to be filled rest in a defined position on a mobile shelf 44 which may be provided with side support members 45. Shelf 44 is mounted to a support plate 46 carried on the shaft 47 of a double-acting cylinder 48 mounted to machine base member 12. Fluid pressure lines 49 and 50 communicate with respective upper and lower chambers in the cylinder within which a piston member if fixed to cylinder shaft 47. Controlled application of fluid pressure to the respective lines 49 and 50 respectively lowers the shelf 44 for case loading and unloading operations and raises the shelf 44 to cause the bottle neck openings to engage respective ones of the securing cups through which the fill tubes extend into the confines of the bottles. As shown in FIG. 1, the shelf is raised to fill position, and the respective fill-valve assemblies are open to permit pressurized fill fluid to enter the bottles.

With the 24 bottle embodiment described herein, the fill tank is divided into 24 compartments as shown in the top section of FIG. 2. Each compartment is oriented over a fill valve assembly, fill tube top seals of which are shown in FIG. 2, as typlified by seal 32 of tube 29 which communicates with fill tank compartment 14.

FIG. 3 (section 3—3 of FIG. 1) shows the vacuum line 42 communicating in common with short tubes which extend through the mounting plate 25 and respective securing cups into the bottle neck confines. As typically depicted for the valve assembly and fill tube associated with bottle 22 of FIG. 1, vacuum line tube 43 extends from common vacuum line 42 through plate 25 and the securing cup 34, along with the fill tube 29. Similar vacuum line tubes communicate with the common line 42 and project through mounting plate 25 and securing cups associated with remaining ones of the fill-valve assemblies. FIG. 3 shows fluid pressure line 38, associated in common with the lower ports on the respective cylinders, and it should be realized that line 37, associated with respective upper ports of the cylinders may be similarly routed. As typically depicted for the valve assembly associated with bottle 22 of FIG. 1, fluid pressure line 38 is connected to lower port 40 of cylinder 26.

FIG. 4 (section 4—4 of FIG. 1) shows the typical fill tube 29 and vacuum tube 43 as passed through the associated securing cup 34, full tube 29 and cup 34 maintaining a sliding seal, and vacuum tube 43 being fixed-sealed in cup 34.

The above described assemblies may be operated in conjunction with a control system as depicted in FIG. 5 to provide an automatic rapid-filling sequence of in-case bottles placed on mobile shelf 44. FIG. 5 includes a compressed air source used to operate the fill valve assembly pistons and to raise and lower the mobile shelf 44. It is to be realized that other fluid pressure sources, such as a compressed gas source, might be utilized in place of compressed air. Further, the mobile shelf might be hydraulically or otherwise operated between the load and fill positions thereof.

The control system of FIG. 5 employs an air compressor 51 applying air pressure through pressure regulator 52 to the air line 41. An air pressure gage 53 is employed to monitor the pressure on air line 41. Air line 41 is connected to a first solenoid operated, four-way directional valve assembly 54. A first de-energized position of valve assembly 54 directs air line 41 to an output air line 49 connected to the upper chamber of two-way cylinder 48. With valve assembly 54 energized, line 41 is connected through valve assembly 54 and air line 50 to the lower chamber of two-way cylinder 48.

Air line 41 is additionally applied to a further solenoid-operated, four-way directional valve assembly 55. A first de-energized position of valve assembly 55 directs air line 41 to an output air line 37 which, as aforedescribed, is connected in common to the upper-chamber ports of the fill valve control cylinders associated with each fill position. With valve assembly 55 energized, line 41 is connected through valve assembly 55 to the lower-chamber ports of the fill valve control cylinders.

FIG. 5 further depicts air line 41 being connected to the fill tank of FIG. 1 to provide pressurization for the soure of fill fluid.

A vacuum pump 56 has an output vacuum line 57 connected through a vacuum pressure regulator 58 to vacuum line 42, which as aforedescribed, is connected in common to tube members extending through the securing cups associated with each fill valve assembly of FIG. 1. Vacuum pressure gage 59 provides for monitoring of vacuum line pressure in the system.

The control system of FIG. 5 provides for a time-controlled fill of in-case bottles placed on mobile shelf 44. For this purpose a power source 60 is connected through timer switch 61 to control line 62 by momentary closing of a control switch 63. Timer switch maintains control voltage on line 62 for a selected period of time. As control voltage is switched on to line 62, solenoid valve assembly 54 is energized to connect the air pressure line 41 via air line 50 two-way cylinder 48 to raise the mobile table 44 upon which the case containing bottles to be filled is oriented. With mobile table in the upper depicted position 44', the in-case bottles are positioned to the filling position of FIG. 1, with the neck openings engaging associated ones of the fill valve securing cups, and with the vacuum line now communicating with the neck confines of the bottles.

As mobile table 44 reaches the fill position 44', a fill switch 64 is closed to apply control voltage on line 62 onto line 65 to thereby energize solenoid controlled valve assembly 55, connecting air pressure line 41 through air line 38 to the bottom chamber ports of the fill valve assemblys, thus raising the associated fill tubes through the securing cups such that the openings in the fill tubes fluidly communicate with the contents of the pressurized fill tank, thus permitting pressurized liquid from the fill tank to rapidly enter and fill the bottles, with the vacuum lines in each bottles providing rapid escape of liquid displaced air from the bottles as they fill. After a period of time set by timer switch 61, the solenoid valve assemblies are de-energized as control voltage on line 62 is removed, whereupon air line 41 is connected via line 37 to the ports of the upper fill-valve cylinders to position the fill tubes downward to stop the fill operation, while air line 41 is connected via line 49 to the upper chamber of mobile table cylinder 48 to lower table 48. With the filled bottles and case thus lowered, the in-case bottle filler ready for reload of a subsequent case of bottles to be filled, with a repeat operation sequence initiated by depression of control switch 63.

It is to be realized that the in-case bottle filler herein described is not limited to incorporation of the automatic timer-fill sequence realizable by the control system of FIG. 5. A manual operation of the table position valve 54 to raise the table to fill position followed in sequence by manual positioning of the fill assembly control valve 55, followed by manual operation of the table valve to load/unload position would provide the unique pressure fill of air evacuated bottles made possible by the described bottle filling apparatus. A further modification might incorporate manual operation of the table positioning valve, with a time controlled fill. In any case, the apparatus provides for control of both fill tank pressure and vacuum pressure to permit desired combinations thereof to most expediently fill bottles with a liquid having a particular viscosity, gas content, foaming tendency, etc.

Whereas this invention is herein illustrated and described with respect to a particular embodiment thereof, it should be realized that various changes may be made without departing from essential contributions to the art made by the teachings hereof.

1. A bottle filling apparatus, comprising an elevatable table upon which at least one bottle may be positioned oriented, a fill tank position-mounted over said table; a fill valve means associated with each bottle to be filled, each said fill valve means comprising a fill tube extending downwardly through the bottom of said tank with the longitudinal axis thereof being coextentive with that of the associated bottle to be filled, each said fill tube slideably received through a fixed-mounted securing cup means having an under surface conformingly and pressure sealably engagable with the neck opening of a bottle to be filled; means for selectively elevating said table; means for air evacuating each of said bottles to be filled upon said table being elevated for engagement between said securing cup means and said bottles; means for pressurizing said fill tank; and means operable upon engagement of said securing cup means and an associated one of said bottles to activate said fill valve means to effect fluid communication between each said fill tube and the confines of said fill tank.

2. The bottle filling apparatus of claim 1, with each said fill valve means comprising selectively operable drive means affixed to said fill tube to translate said fill tube between upper and lower vertical positions, pressure sealing bushing means communicating with said fill tank and through which said fill tube is slideably receivable while maintaining a pressure seal therewith, each said fill tube being closed at the upper end thereof and having a port opening formed in the wall thereof and disposed a predetermined distance below the fill tube upper end, with said fill tube drive means being operable to position said fill tube opening into the confines of said fill tank in a first position thereof and into the confines of said pressure scaling bushing means in a second position thereof.

3. The bottle filling apparatus of claim 2 with said selectively operable drive means comprising a double acting fluid pressure operated piston and cylinder with said fill tube passing through and affixed to said piston, said pressure sealing bushing means comprising the top bushing of said cylinder with said fill tube being slidably receivable through and maintaining a sliding pressure seal with a further pressure sealing bushing means which comprises the bottom bushing of said cylinder; a source of fluid pressure, and means for selectively applying said source of fluid pressure to upper and lower chamber ports of said double acting cylinder.

4. The bottle filling apparatus of claim 3 with a further double acting fluid pressure operable cylinder affixed to a fixed apparatus base mounting means and having a piston displaceable output shaft affixed to said table, with a first position of said piston defining a first table elevation effecting vertical clearance between fill tube bottom extremes and neck openings of selected bottles to be filled and a second position defining a second table elevation effecting communicating engagement between said securing cup means and the neck openings of an associated bottle.

5. The bottle filling apparatus of claim 4, with control means to preclude application of said fluid pressure source to the lower chamber ports of said fill valve cylinders with said table being other than in said second table elevation position thereof.

6. The bottle filling apparatus of claim 5 with said means for air evacuating said bottles comprising a vacuum pump with output vacuum line connected in common to ones of fixed position further tube members extending through said securing cup means for extention into the upper confines of a bottle engaging said securing cup means.

7. The bottle filling apparatus of claim 6, with the upper ports of each of said fill valve cylinders connected in common to a first fluid pressure line and the lower chamber ports thereof connected in common to a second fluid pressure line, said control means comprising fluid pressure valve means receiving said fluid pressure source as input thereto and operable in first and second positions thereof to connect said fluid pressure source to respective ones of said first and second fluid pressure lines.

8. The bottle filling apparatus of claim 7 with said fluid pressure valve means comrising a solenoid operated four-way directional valve, said control means comprising a control voltage source and timing means for de-energizing said solenoid a predetermined time after energization thereof to thereby control the fill time of said bottles.

9. The bottle filling apparatus of claim 8 with switch means impact operated by said table in the second elevation position thereof to connect said control voltage source to said solenoid.

10. The bottle filling apparatus of claim 9 with means connected with the outputs of each of said fluid pressure and vacuum sources to selectively and individually adjust the pressures on each of said fluid pressure and vacuum lines.

11. In a bottle filling device of the type employing means to raise a bottle to be filled into communication with a fill valve assembly, including a fill tube extending into the confines of the bottle and means for selectively effecting a fluid communication between the fill tube and the confines of overlying fill tank; means for air evacuating said bottle upon said bottle being raised into said fill valve communication, comprising a securing cup member having a lower face conformingly and pressure sealably engageable with the neck opening of said bottle, with said fill tube extending through said securing cup member and into the confines of said bottle with engagement between said cup and bottle, a fluid communication port means extending through said cup member, said fluid communication port means being connected to a vacuum source, whereby air evacuation of said bottle is effected upon communication between said bottle neck opening and said securing cup member.

12. The device of claim 11, with said fill tube being vertically translatable between positions respectively effecting fluid communication and non-communication between said fill tube and said fill tank confines, said securing cup members being fixed positioned, and said fill tube and securing cup maintaining a sliding pressure seal over the displacement range of said fill tube.

* * * * *